US009029672B1

(12) United States Patent
Manger et al.

(10) Patent No.: US 9,029,672 B1
(45) Date of Patent: May 12, 2015

(54) BOWED STRINGED MUSICAL INSTRUMENT WITH MOVABLE BOWING SURFACE AND ORTHOGONAL STRING DISPLACEMENT

(71) Applicant: Antiquity Music LLC, Los Angeles, CA (US)

(72) Inventors: Mitchell Manger, Beverly Hills, CA (US); Jon Jones, Ironton, MO (US)

(73) Assignee: Antiquity Music LLC, Los Angeles, CA (US)

( * ) Notice: Subject to any disclaimer, the term of this patent is extended or adjusted under 35 U.S.C. 154(b) by 0 days.

(21) Appl. No.: 14/152,965

(22) Filed: Jan. 10, 2014

Related U.S. Application Data

(60) Provisional application No. 61/751,771, filed on Jan. 11, 2013.

(51) Int. Cl.
*G10C 1/00* (2006.01)
*G10D 1/00* (2006.01)

(52) U.S. Cl.
CPC ... *G10D 1/00* (2013.01); *G10C 1/00* (2013.01)

(58) Field of Classification Search
CPC ..... G10C 1/00; G10D 1/00
See application file for complete search history.

(56) References Cited

U.S. PATENT DOCUMENTS

| | | | | | |
|---|---|---|---|---|---|
| 727,665 | A | * | 5/1903 | Moen | 84/257 |
| 1,190,655 | A | * | 7/1916 | Keller | 84/257 |
| 1,326,955 | A | * | 1/1920 | Mueller | 369/30.01 |
| 1,344,497 | A | * | 6/1920 | Fleming | 84/326 |
| 1,409,322 | A | * | 3/1922 | Warner | 84/256 |
| 1,555,762 | A | * | 9/1925 | Silen | 84/256 |
| 1,577,501 | A | * | 3/1926 | Strawn | 84/326 |
| 1,742,057 | A | * | 12/1929 | Corwin | 84/10 |
| 2,327,072 | A | * | 8/1943 | Silen | 84/256 |
| 3,049,958 | A | * | 8/1962 | Benioff | 84/731 |
| 3,090,274 | A | * | 5/1963 | Fender | 84/209 |
| 3,628,414 | A | * | 12/1971 | Elteto | 84/257 |
| 4,084,473 | A | * | 4/1978 | Kitashima et al. | 84/731 |
| 4,913,026 | A | * | 4/1990 | Kaneko et al. | 84/21 |
| 5,212,336 | A | * | 5/1993 | Barcus | 84/730 |
| 5,286,911 | A | * | 2/1994 | Murata et al. | 84/615 |

OTHER PUBLICATIONS

Ripin et al. Early Keyboard Instruments, (MacMillan, London, 1980) excepts on the geigenwerk.*

Obuchi, "Making a Bowed Keyboard Instrument", http://obuchi.music.coocan.jp/Geigenwerk/Geigenwerk1/Report/REPORT.html, Mar. 29, 1993, 4 pages.

* cited by examiner

*Primary Examiner* — Robert W Horn
(74) *Attorney, Agent, or Firm* — Fish & Richardson P.C.

(57) ABSTRACT

A musical instrument includes a soundboard, a bridge in contact with the soundboard, vibratable strings in contact with the bridge, a movable member disposed adjacent to the vibratable strings, a driving mechanism engaged with the movable member and configured to cause the movable member to move relative to the vibratable strings, and actuators. Each actuator is configured to displace, when actuated, an associated vibratable string such that the string is caused to come into contact with the movable member at a point of contact. Displacement of the string corresponds to movement within a first plane that is orthogonal to a second plane, the second plane being tangential to the movable member at the point of contact.

47 Claims, 23 Drawing Sheets

BOWED STRINGED MUSICAL INSTRUMENT WITH MOVABLE BOWING SURFACE AND ORTHOGONAL STRING DISPLACEMENT

CROSS-REFERENCE TO RELATED APPLICATION

This application claims the benefit under 35 U.S.C. §119 (e)(1) of U.S. Provisional Application No. 61/751,771, filed on Jan. 11, 2013, which is incorporated by reference herein.

TECHNICAL FIELD

This application relates to bowed stringed musical instruments.

BACKGROUND

Bowed stringed musical instruments are instruments that produce sound by the vibration of a string that has been brought into contact with a bowing surface. Typically, in such instruments, bowing occurs as a frictioned surface moves relative to a string that is anchored at one end to a bridge; the string vibrates, the string's vibrational energy is transferred via the bridge to a soundboard or other mechanical structure, and sound is produced as the soundboard resonates.

SUMMARY

This application describes a bowed stringed musical instrument that produces sound by bringing one or more vibratable strings into contact with a movable member, driven by a driving mechanism such as a rotating shaft and preferably coated with a high-friction substance such as rosin, whereby the resulting string vibrations are transferred to a soundboard by a bridge. In response, the soundboard resonates at frequencies within the range of the human auditory system to generate changes in acoustic pressure that the human ear detects and recognizes as sound. This sound generation mechanism is similar to stringed instruments such as the violin, where a rosined bow is drawn across one or more strings to generate string vibrations that are transferred to a resonant soundboard. The present instrument thus is capable of generating tones reminiscent of violin-like instruments. However, by employing a driving mechanism shaft to move a movable bowing surface—as opposed to a violin bow, for example, which is moved back and forth by the human arm—the instrument is capable of generating notes of indefinite sustain. Further, the strings can be brought into contact with this surface by any of a number of actuation mechanisms, such as piano-like keys, which operate as discrete note selectors. Each actuator displaces a corresponding string in a plane orthogonal to the plane tangent to the movable member at a point where the string will contact the surface. The resulting angle at which the string contacts the movable member helps achieve optimal transfer of any kinetic energy of the movable member to vibrational energy of the string. Further, by selecting notes by actuating these actuators, rather than by changing the length of a single vibrating string, as with a violin, the user can employ common piano and keyboard techniques to generate violin-like sounds. Further, by employing a greater number of fixed-length strings—as opposed to a lesser number of variable-length strings, as in a violin—the instrument may be made capable of generating complex harmonies that result from bowing many strings at once.

Certain implementations may provide other potential advantages. For example, one such advantage may be to improve the instrument's usability in diverse musical applications. One way this advantage may be achieved is by increasing the instrument's maximum attainable perceived sound volume relative to input kinetic energy. This improves the instrument's usability in band or orchestral settings, by making it better able to compete for volume with louder instruments, without the assistance of electrical amplification. It also improves the instrument's usability in recording settings, where the signal-to-noise ratio of the recorded instrument—a metric directly related to the sound quality of recorded music—increases with the instrument's natural acoustic volume. One way that certain implementations increase the maximum attainable perceived sound volume is by displacing a string such that as much of the moving surface's kinetic energy as possible is transferred to resultant vibrational energy of the string, which is related to the acoustic pressure, and thus the perceived sound volume, of the instrument. Another way is by encouraging a soundboard to resonate with maximum displacement, which helps translate more of a bowed string's vibrational energy to acoustic pressure, thereby increasing the perceived sound volume of the instrument. In some implementations, soundboard displacement is increased by employing a pivot post, coupled to the bridge at a single point of contact, such that vibration of a string causes the bridge to vibrate around the point of contact.

Another way that usability in diverse musical applications may be improved in certain implementations is by allowing the use of "drone" strings, which remain in contact with a moving surface without requiring actuation; these strings provide "pedal" tones which are highly characteristic of certain genres of music, such as the traditional music of Ireland, Scotland, and India.

Another way that usability in diverse musical applications may be improved in certain implementations is by enabling the use of dynamic acoustic effects, such as tremolo and phasing, and acoustic dampening effects.

Another way that usability in diverse musical applications may be improved in certain implementations is by converting string vibration to electrical signals, allowing the instrument to be interfaced with electrical amplification, electronic signal processing equipment, and recording equipment. This conversion may be performed, for example, by an electromagnetic pickup; a piezoelectric transducer; or a microphone.

Another way that usability in diverse musical applications may be improved in certain implementations is by allowing actuators to be controlled by Musical Instrument Digital Interface (MIDI) signals. For example, a MIDI signal could encode pitch and note velocity information and direct the strings of the instrument to produce notes of the encoded pitch and velocity.

Another potential advantage is improving ease of operation by musicians of various backgrounds and skill levels. For example, certain implementations help ensure uniformity of sound volume across all strings of the instrument by displacing strings toward a moving surface such that all strings contact the surface at the same angle. The instrument is made easier to operate because the operator can rely on all strings being bowed with roughly consistent amplitude, thus producing roughly consistent sound volume across strings—a desirable characteristic of stringed instruments—without the need for the operator to manually compensate for differences in volume across strings.

As another example, certain implementations feature a linear array of actuators, such as keys. This may improve ease of operation because musicians skilled with common instruments featuring linear keyboards, such as pianos or accordions, can transfer their skills directly to the presently described instrument.

Certain implementations also connect such actuators to strings via a cable linkage system, which helps allow the linear keyboard, which improves the instrument's ease of operation, to coexist with the orthogonal string displacement, which improves the instrument's usability in diverse musical applications.

Another potential advantage is ease of manufacturing, which results in a lower cost of manufacture. This advantage may be provided, for example, by implementations with a tubular soundboard, because it is easier for a manufacturer to attach a radial bridge (as might be used in bowed stringed musical instruments that employ a wheel) to a tubular soundboard than to a flat soundboard. This advantage may also be provided, for example, by implementations that have a radial keyboard, with actuators spaced around a curved surface, because the uniformity of the distance and positioning of each key relative to its respective string allows for an identical action for every note throughout the keyboard, which makes the instrument easier to manufacture.

Another potential advantage is compactness of the instrument, which assists portability and better enables the instrument to be used in small venues. This may be provided, for example, by implementations that have a radial keyboard, with actuators spaced around a curved surface. Radial keyboards take up less linear space than a linear keyboard with the same number and size of keys. This advantage may also be provided by implementations with a string tension adjustment mechanism, which increases the number of playable notes without increasing the number of strings required.

Another potential advantage is ease of user adjustment and calibration, which reduces the time and effort a manufacturer must spend to provide user support. This advantage may be provided, for example, by implementations that have a bridge coupled to a user-adjustable pivot post, because the user-adjustable pivot post allows the user to calibrate the bridge-and-soundboard system (and help achieve optimal acoustics) without disassembling the instrument, which presumably would require the assistance of the manufacturer.

Another potential advantage is consistency of volume among notes, which is a generally desirable characteristic of stringed instruments. This advantage may be provided for example by implementations that drive the moving surface with a motor, because motors can provide a more consistent rotational velocity and thus a more consistent bowing amplitude than can, for example, a human-powered moving surface.

Another potential advantage is energy efficiency, which may be provided for example by implementations that feature a human-powered moving surface, because this eliminates the need to power the moving surface with an external energy source, such as fuel or electricity.

Other aspects, features, and potential advantages will be apparent from the following figures and detailed description.

DETAILED DESCRIPTION

Figure 1A:
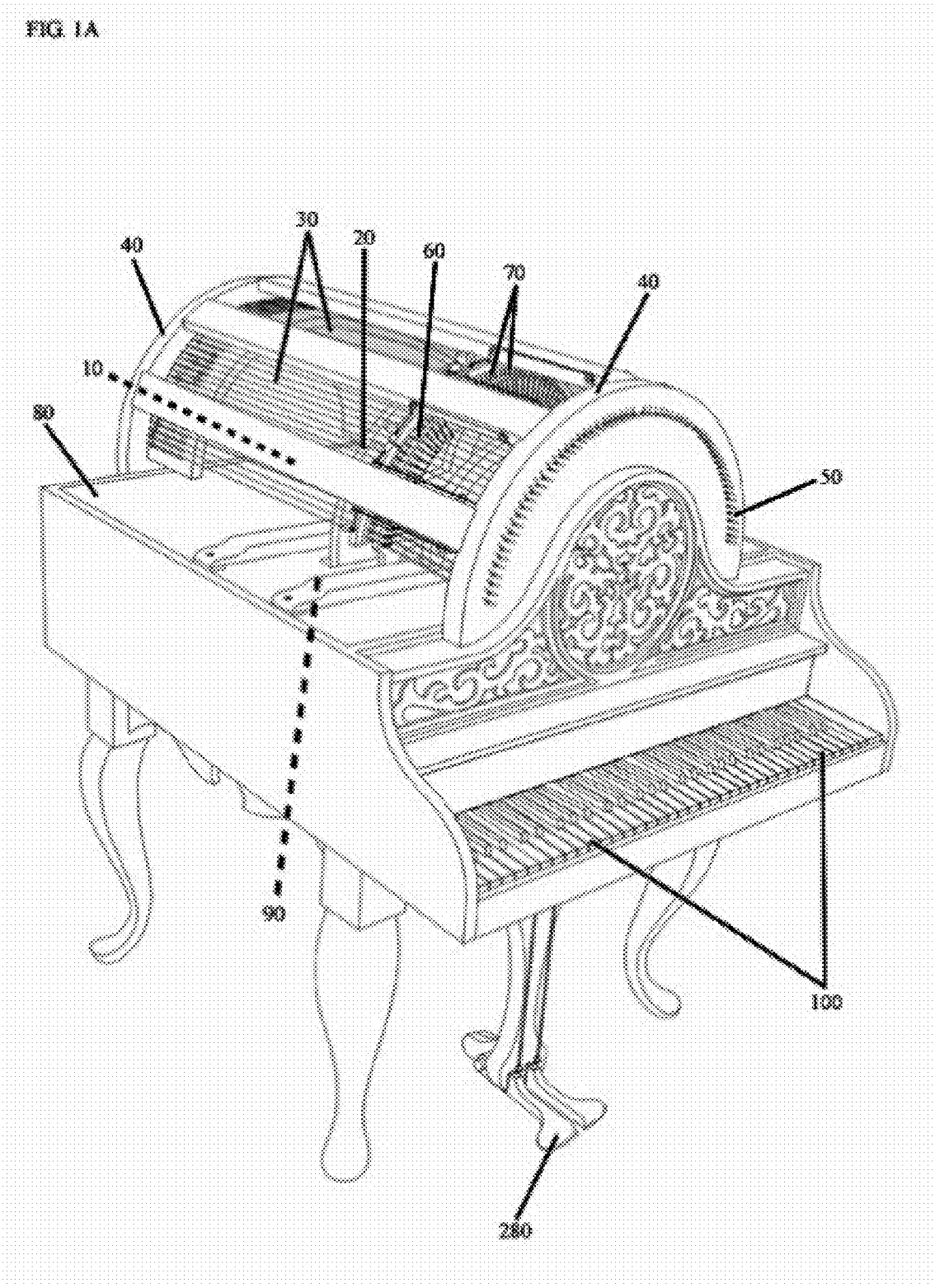
FIG. 1A shows a perspective view of a musical instrument.
Figure 1B:
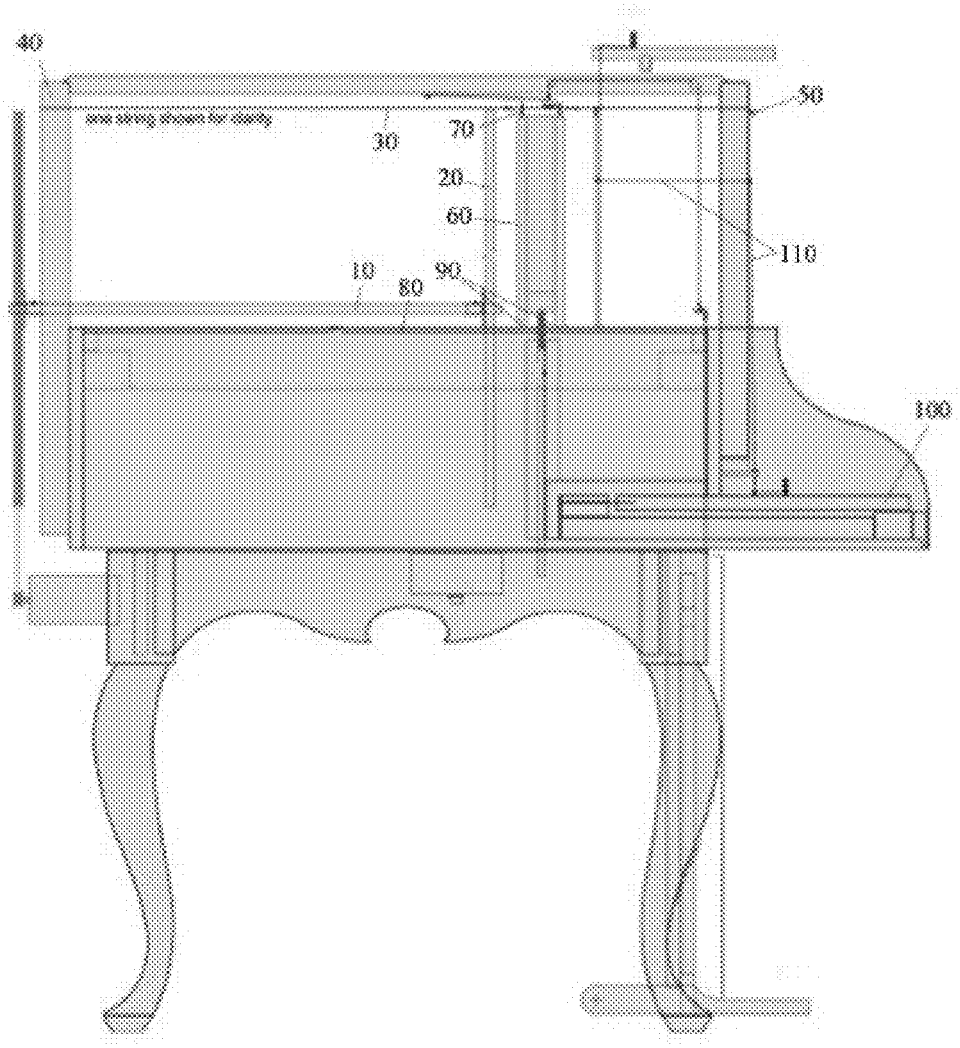
FIG. 1B shows a side view of a musical instrument.
Figure 1C:
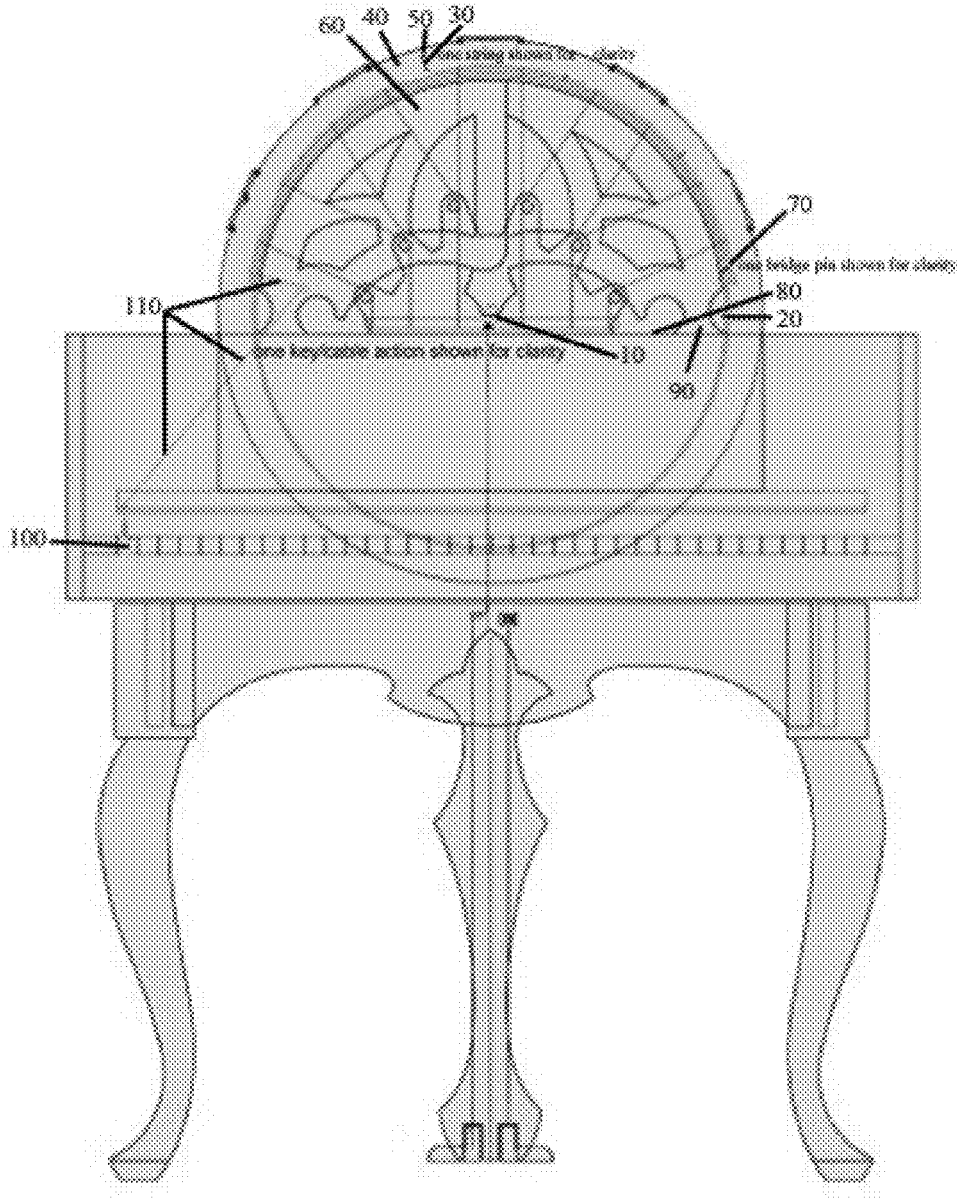
FIG. 1C shows a front view of a musical instrument.

Referring to FIGS. 1A, 1B, and 1C, a driving mechanism 10 causes movement of movable member 20, disposed adjacent to a plurality of vibratable strings 30. A plurality of actuators 100, each actuator corresponding to an associated vibratable string 30, is configured to displace vibratable strings 30 such that said strings come into contact with movable member 20 at at least one point of contact. Movable member 20 has a coefficient of friction such that when movable member 20 is in motion and is brought into contact with vibratable strings 30, kinetic energy of the movable member 20 is transferred to vibrational energy of the vibratable strings 30. Vibratable strings 30 are stretched between two end plates 40 and anchored at one end by tuning pins 50. Vibratable strings 30 are coupled to a bridge 60 by bridge pins 70 that are spaced around the bridge 60. Bridge 60 is coupled to a soundboard 80 via bridge feet 90, such that vibrational energy of the vibratable strings 30 is transferred via the bridge 60 to vibrational energy of the soundboard 80. This vibrational energy causes the soundboard 80 to resonate at frequencies within the range of human hearing, creating changes in acoustic pressure that the human ear perceives as sound.

Figure 2:
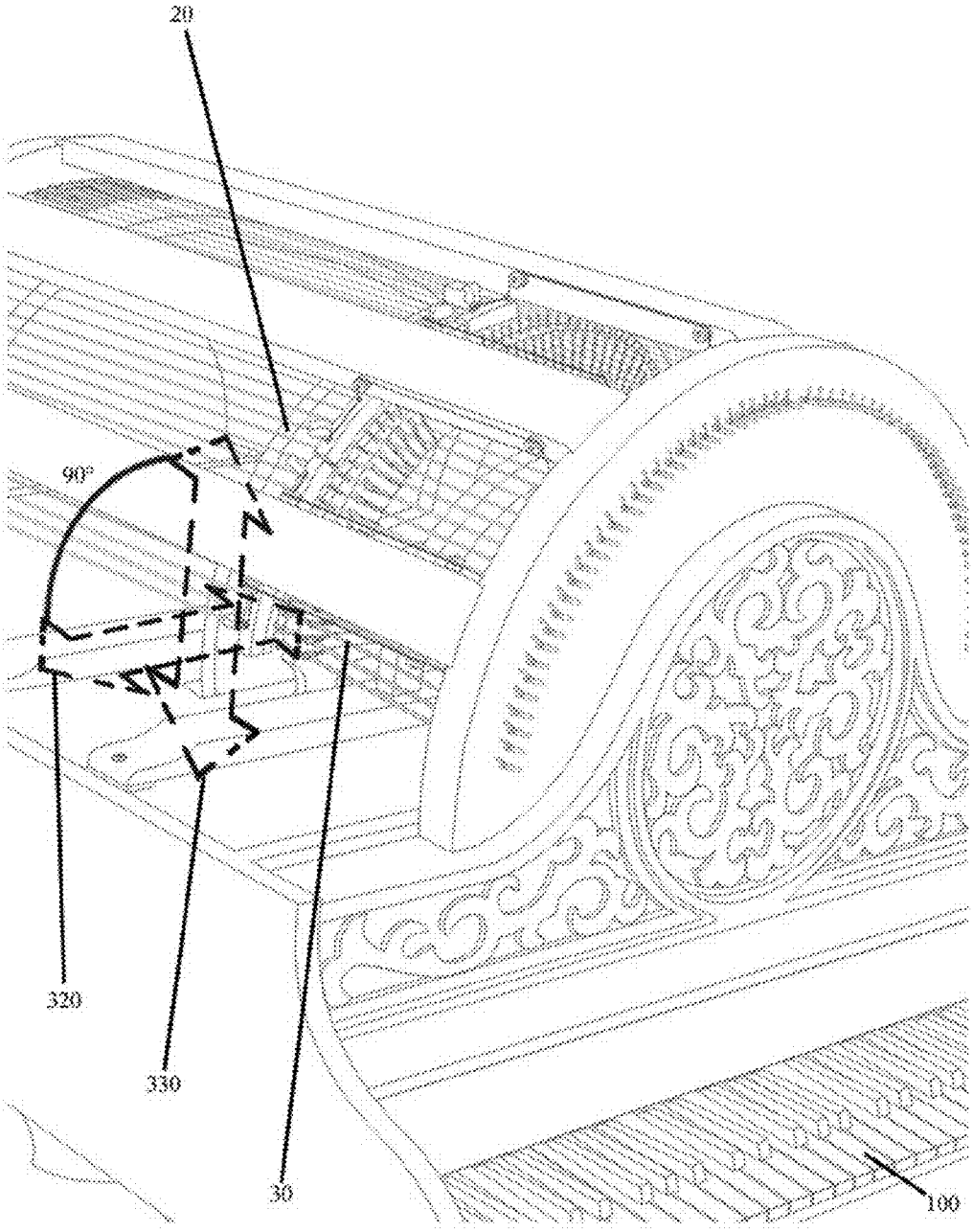
FIG. 2 shows a perspective diagram illustrating string displacement orthogonal to a movable member.
Figure 2A:
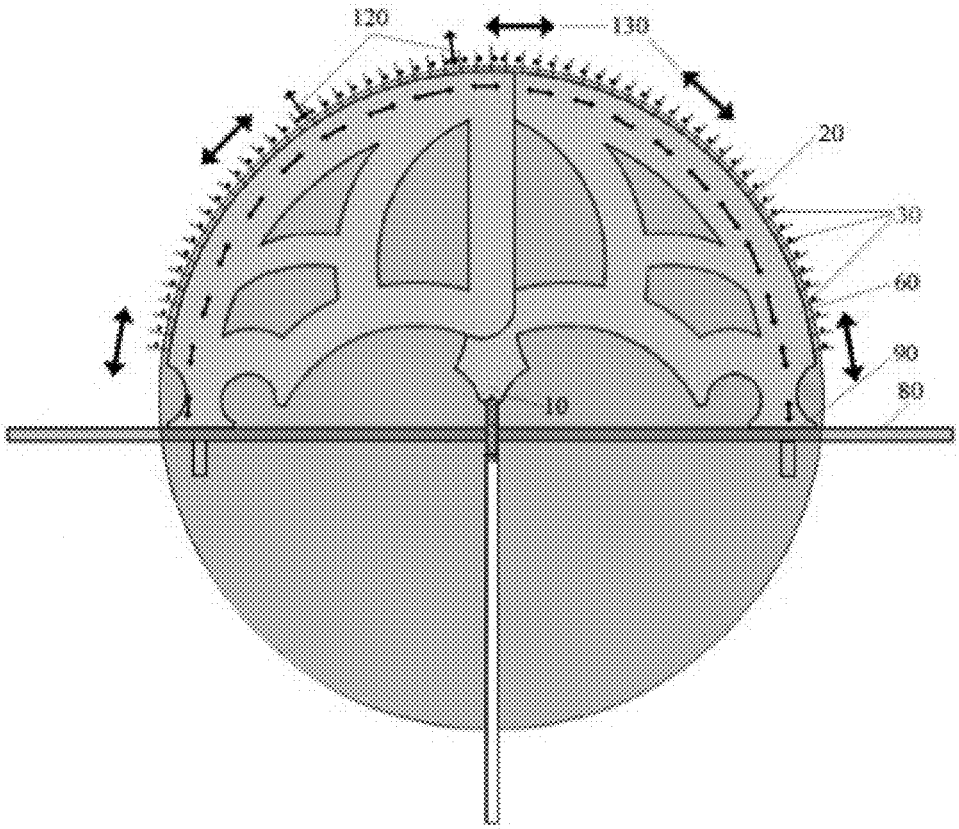
FIG. 2A shows a schematic diagram illustrating string displacement orthogonal to a movable member.
Figure 2B:
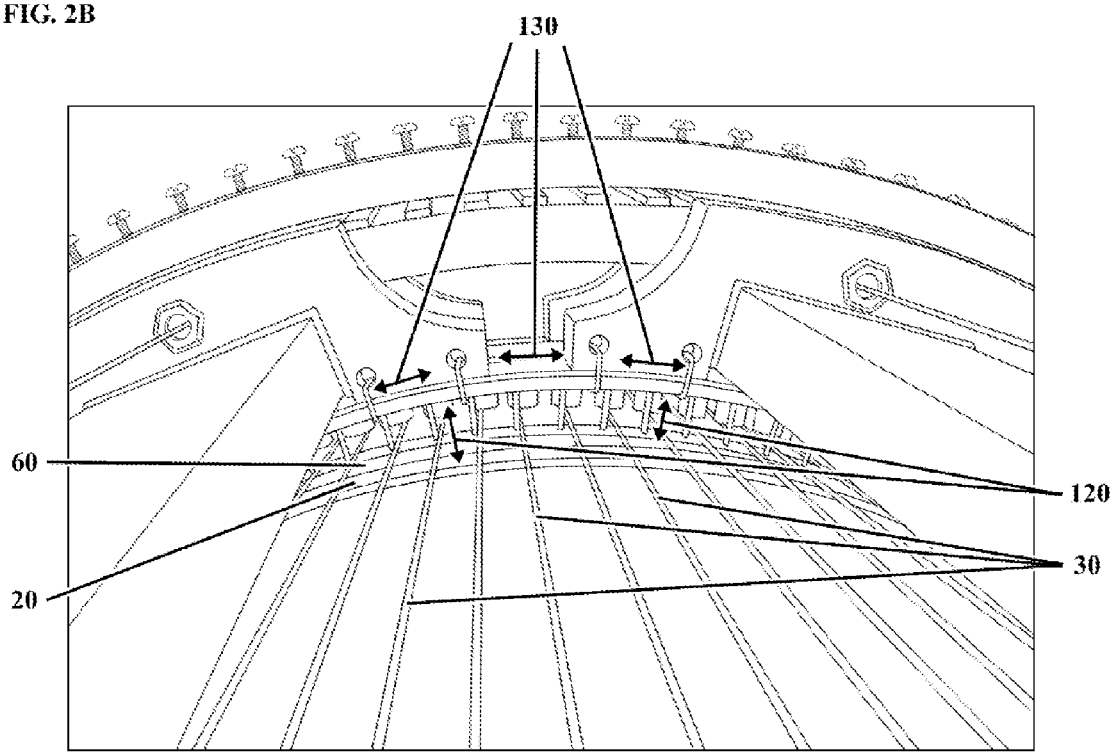
FIG. 2B shows a perspective photo illustrating string displacement orthogonal to a movable member.

Referring to FIG. 2, for each of the vibratable strings 30, a corresponding member of actuators 100, when actuated, displaces the vibratable string 30 in a plane perpendicular to the plane tangent to the movable member 20 at a point where the vibratable string 30 contacts the movable member 20. FIG. 2A shows the front view of an implementation in which the driving mechanism 10 is a single rotating shaft, and movable member 20 is a single cylinder that rotates with said shaft. The wheel and shaft rotate around an axis directed into the page. Arrows 120 show the vectors along which each vibratable string 30 is displaced; each such vector is perpendicular to the plane tangent to the movable member 20 at the point where vibratable string 30 contacts the movable member 20. Arrows 130 show the vectors along which the vibratable string 30 vibrates when contacting the movable member 20; each vector is in said plane. FIG. 2B shows a perspective view of one such implementation. Movable member 20 need not be cylindrical, or entirely curved; in some implementations, movable member 20 comprises a belt that is driven by a driving mechanism 10 that rotates two or more shafts, around which the belt is displaced.

Figure 3:
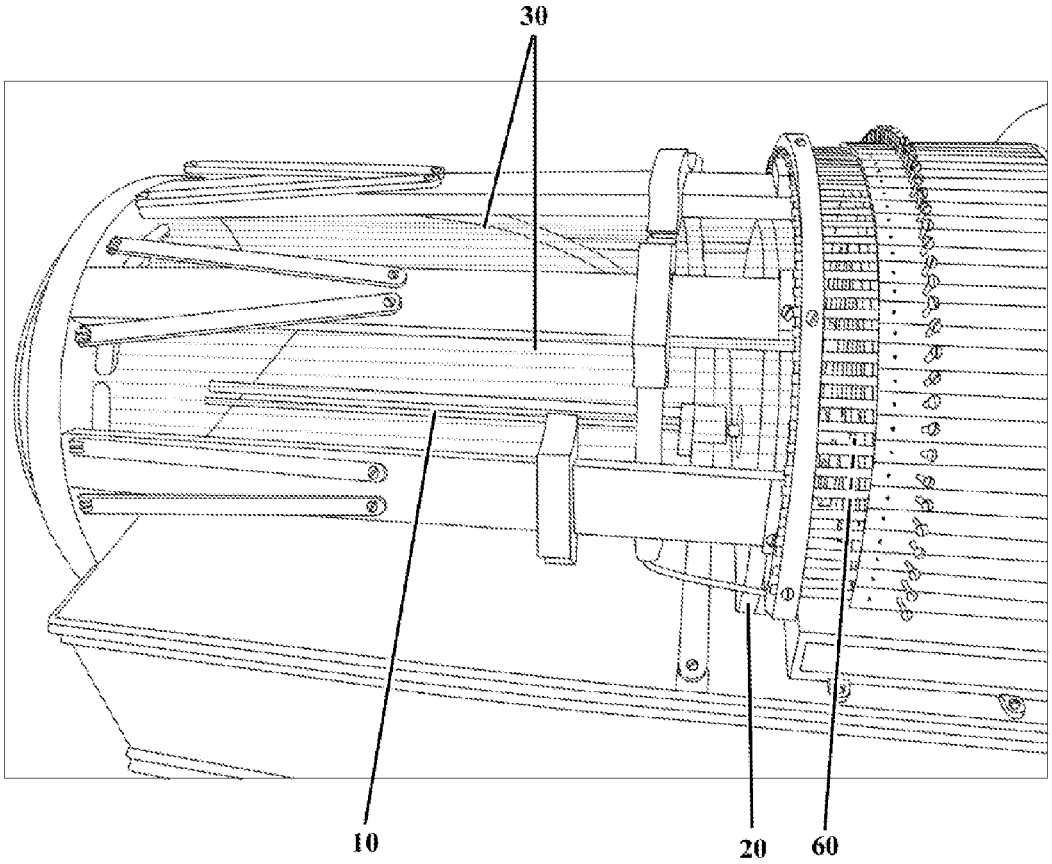
FIG. 3 shows a rotating shaft and attached movable member.

In a particular implementation, pictured in FIG. 3, driving mechanism 10 is a single shaft that rotates a wheel, with radius approximately sixteen inches, whose movable outer surface 20 is coated in a high-friction material, such as rosin. Bridge 60 comprises a curved outer surface whose curvature approximates the curvature of the movable member 20, and to which a plurality of vibratable strings 30 is attached. The tension of each vibratable string 30 is adjusted, preferably by tuning pins 50, such that bowing the vibratable string 30 plays a note in the chromatic scale, and that bowing adjacent strings 30 results in playing adjacent notes in the chromatic scale. Sixty-one vibratable strings 30 may be used to allow a pitch range of five octaves. More vibratable strings 30 may be used if a greater chromatic range is desired. Fewer vibratable strings 30 may be used if wider string spacing is desired, or if a smaller movable member 20 is desired.

Figure 4:
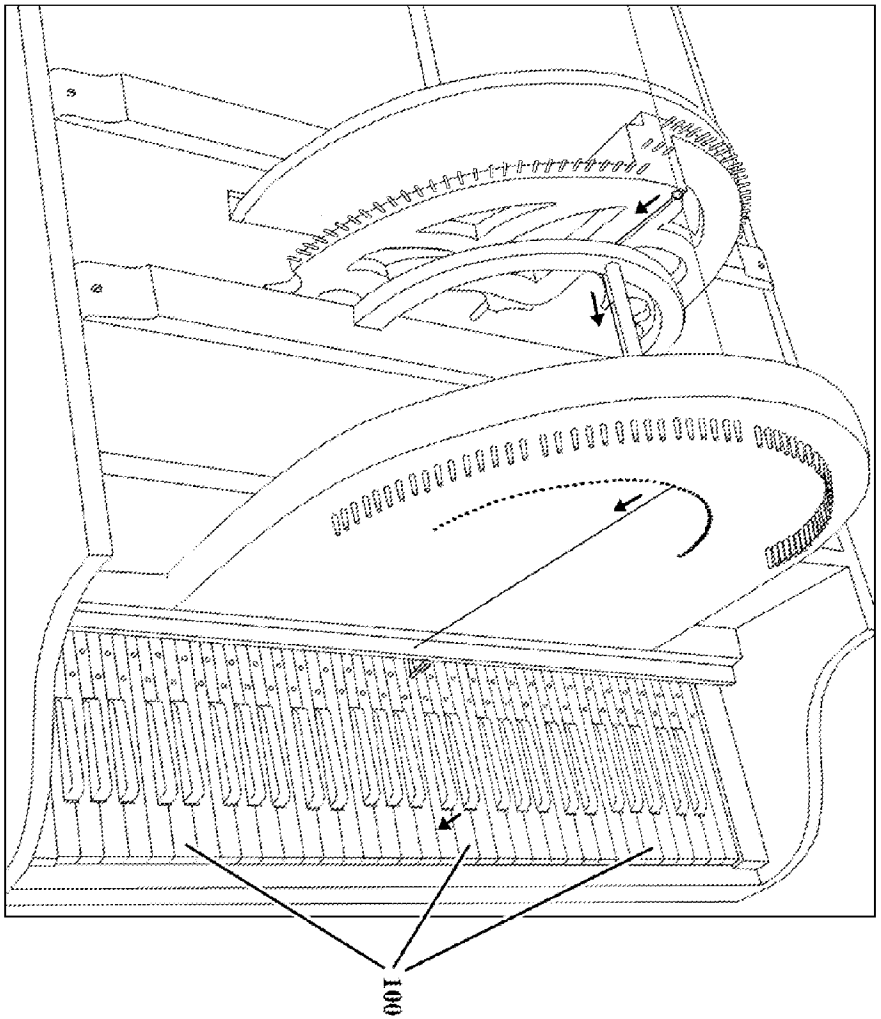
FIG. 4 shows key actuators arranged linearly.
Figure 5:
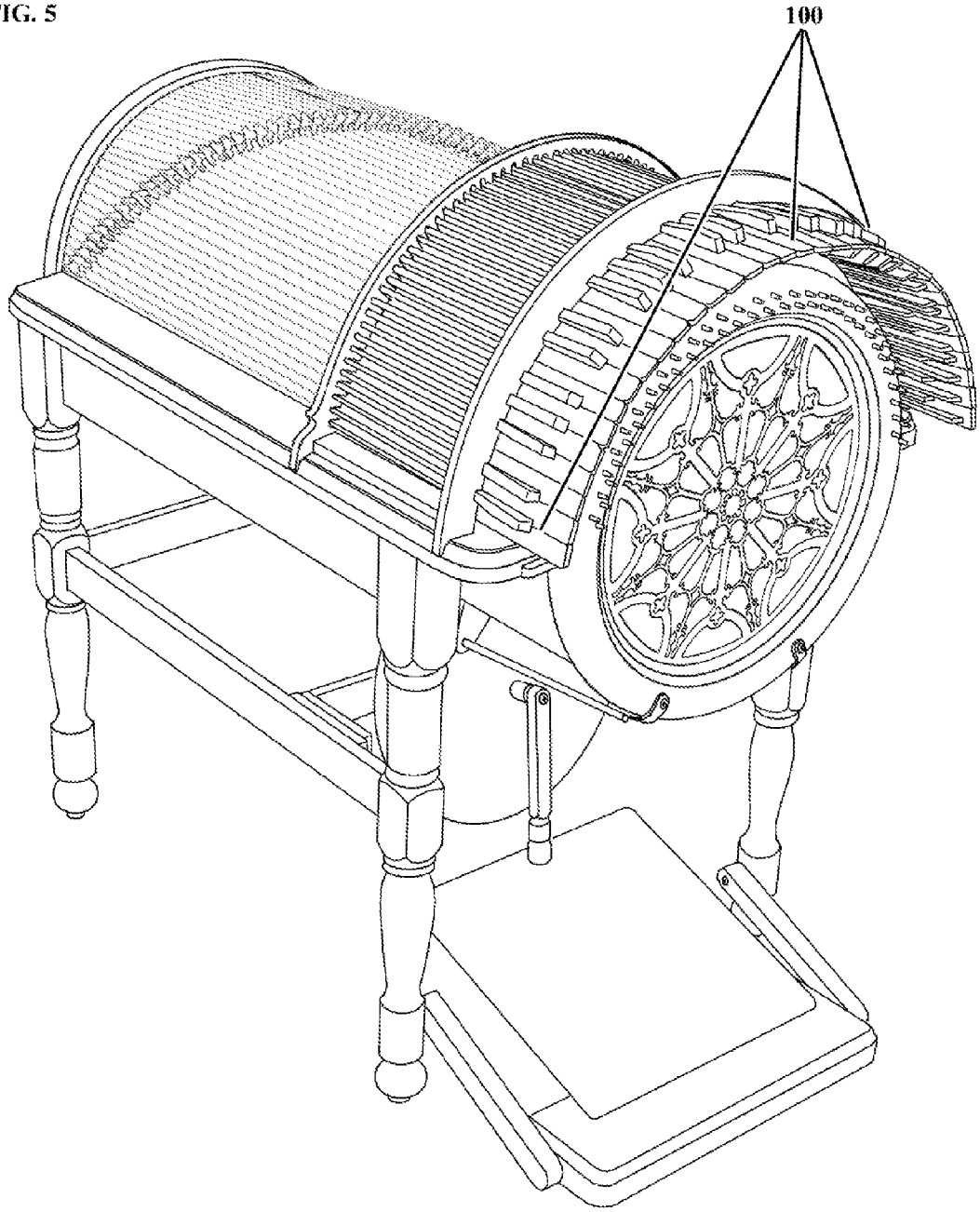
FIG. 5 shows key actuators arranged radially.

In some implementations, such as shown in FIG. 4, each actuator 100 is a key such as those found in a piano. In a particular implementation, shown in FIG. 4, the keys are arranged in a straight line, as in a piano, helping musicians accustomed to the piano and similar keyboard instruments to acquire skill with the presently described instrument. In another particular implementation, shown in FIG. 5, the keys are arranged along a curved surface, allowing more compact embodiments of the instrument and lending a unique feel and appearance.

Figure 6:
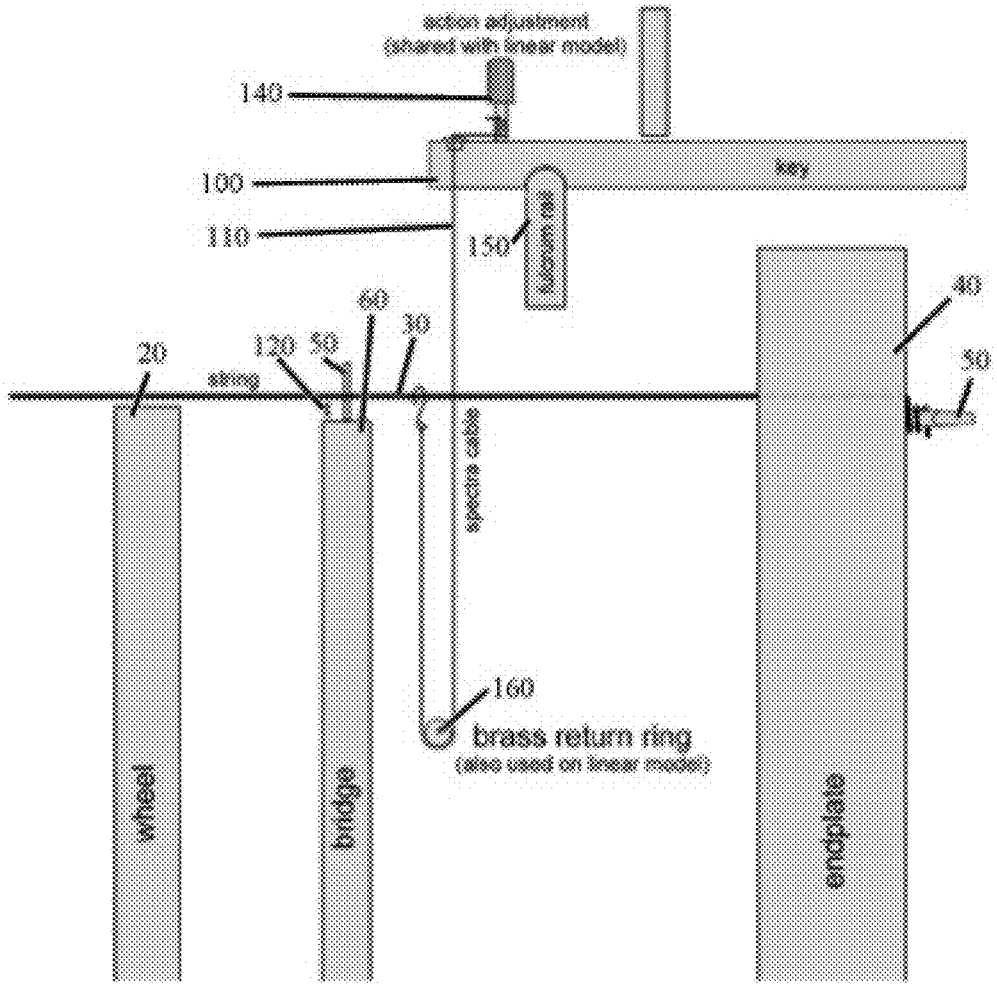
FIG. 6 shows a cable linkage system connecting actuators to strings.

Some implementations may feature a cable linkage system, an example of which is shown schematically in FIG. 6, to connect the actuators 100 to vibratable strings 30. In FIG. 6, actuators 100 are keys as described above. Cables 110 are wound around knurled shafts 140 that are mounted on the keys. Depressing the keys causes the keys to act as levers around one or more fulcrums 150, pulling cables 110. Cables 110 are wrapped around a distribution ring 160, which may be a cylinder, and fan out toward vibratable strings 30 such that they displace vibratable strings 30 toward movable member 20 when pulled. Distribution ring 160 need not be orthogonal to the plane formed by the lengths of cable 110 extending between actuator 100, distribution ring 160, and vibratable string 30. This allows an arrangement of actuators 100 that does not share the same curvature as movable member 20.

Figure 7A:
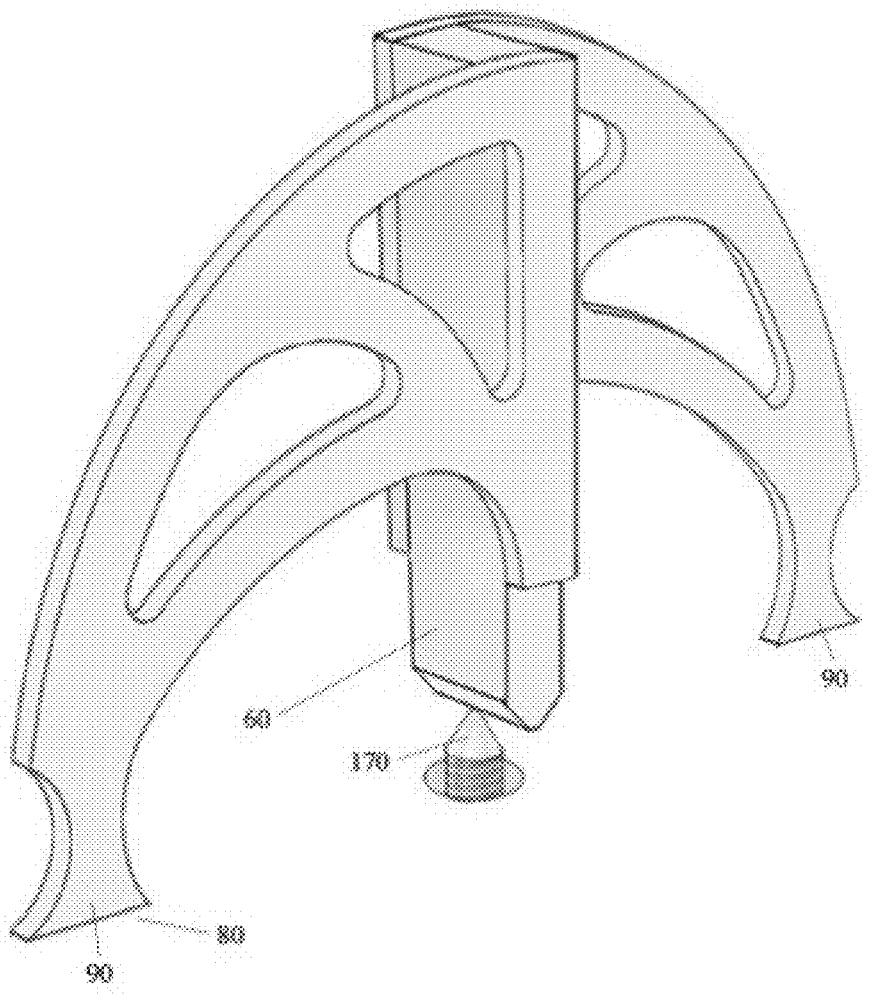
FIGS. 7A, 7B, 7C, and 7D show a pivoting bridge mechanism.
Figure 7B:
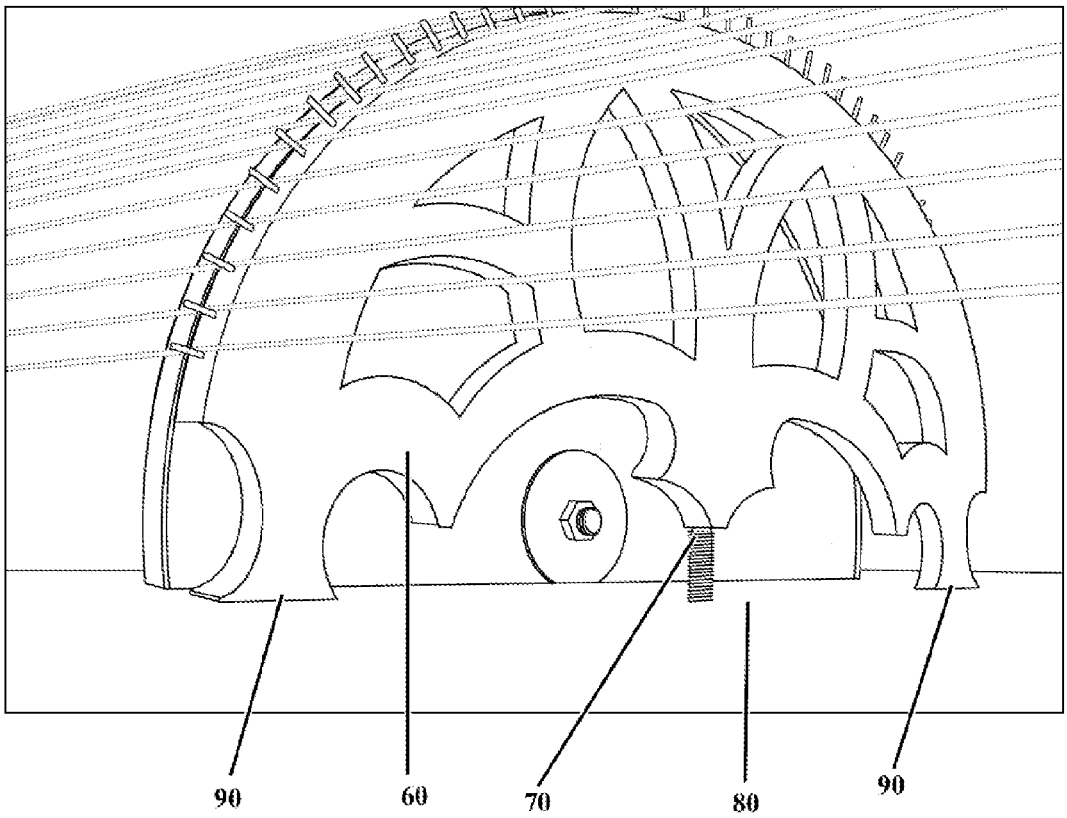
Figure 7C:
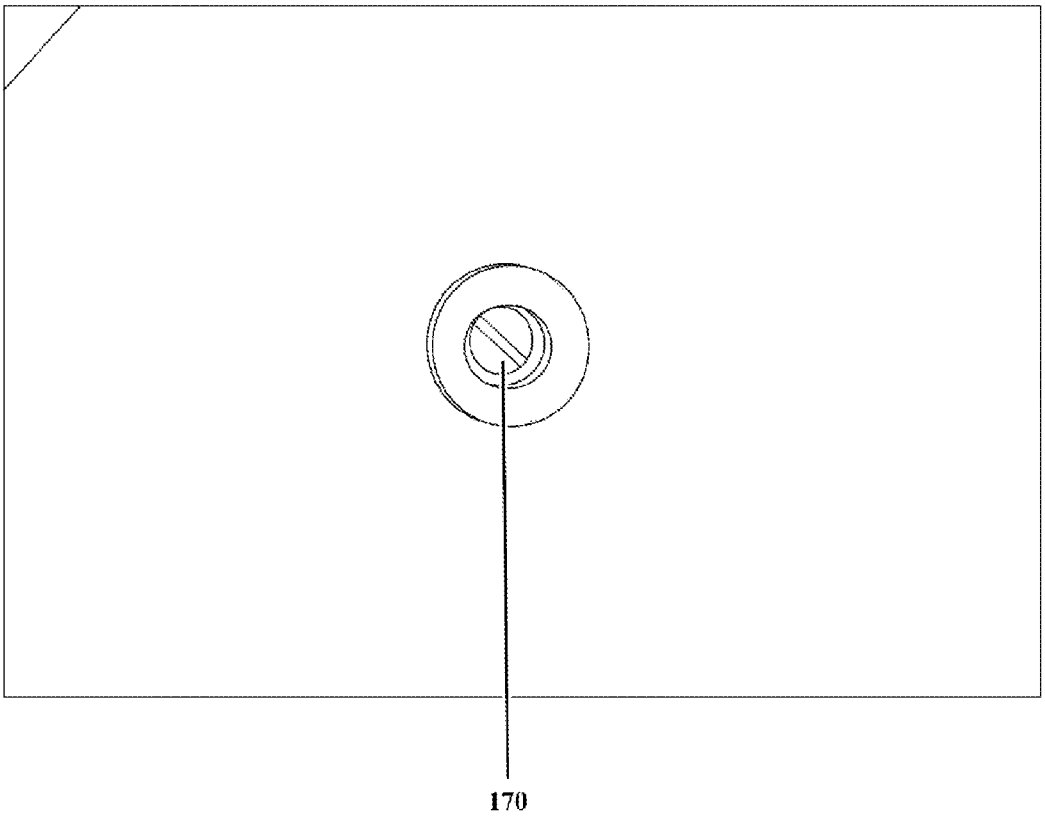
Figure 7D:
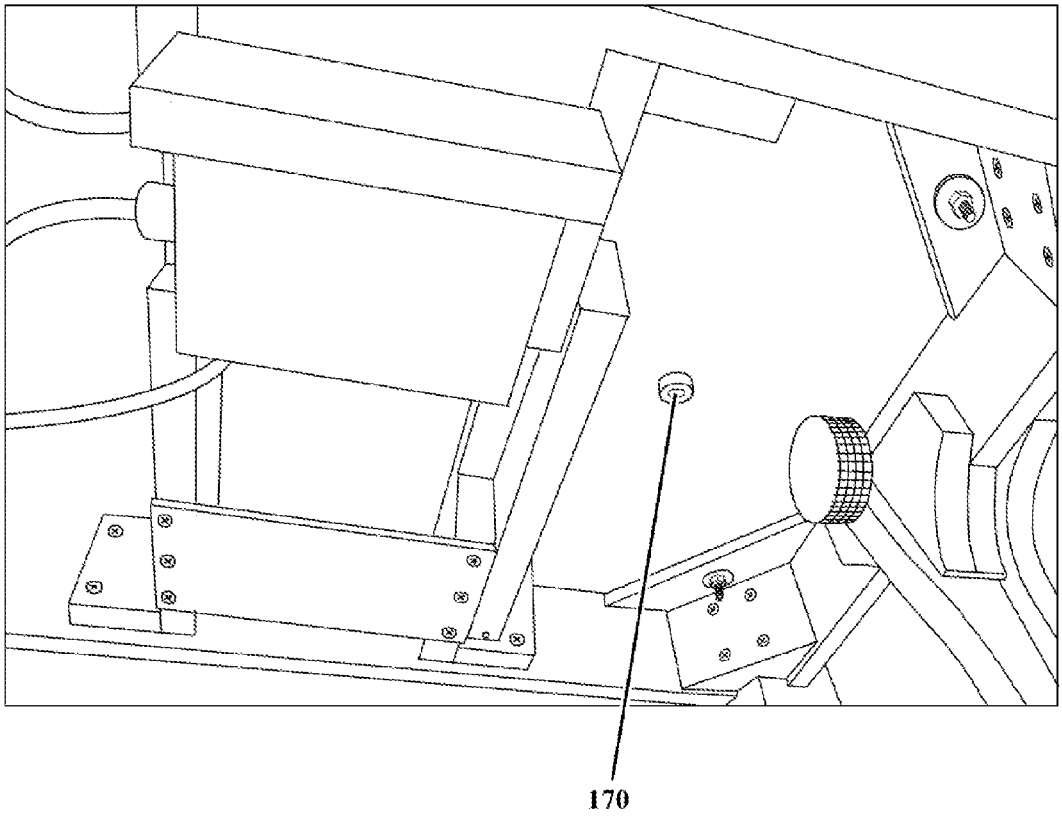

Referring to FIG. 7A, in a particular implementation, bridge 60 is attached to soundboard 80 by bridge feet 90. The bridge 60 rests on a pivot post 170, which is directed upwards through the soundboard 80 toward the bridge 60, and is threaded such that it can be raised and lowered like a screw. The bridge preferably vibrates freely around an axis parallel to the axis of rotation of driving mechanism 10. Raising the pivot post 170 forces the bridge 60 away from the soundboard 80, decreasing the normal force applied to the bridge 60 by the soundboard 80 via the bridge feet 90. Conversely, lowering the pivot post 170 increases said normal force. Manipulating said normal force adjusts the amplitude with which the soundboard 80, connected to the bridge 60 via bridge feet 90, will vibrate relative to the pivot post 170. Increasing this amplitude will result in a higher perceived volume, as the soundboard 80 is able to effect larger changes in acoustic pressure. FIGS. 7B, 7C, and 7D illustrate bottom views of the adjustable pivot post 170.

Figure 8:
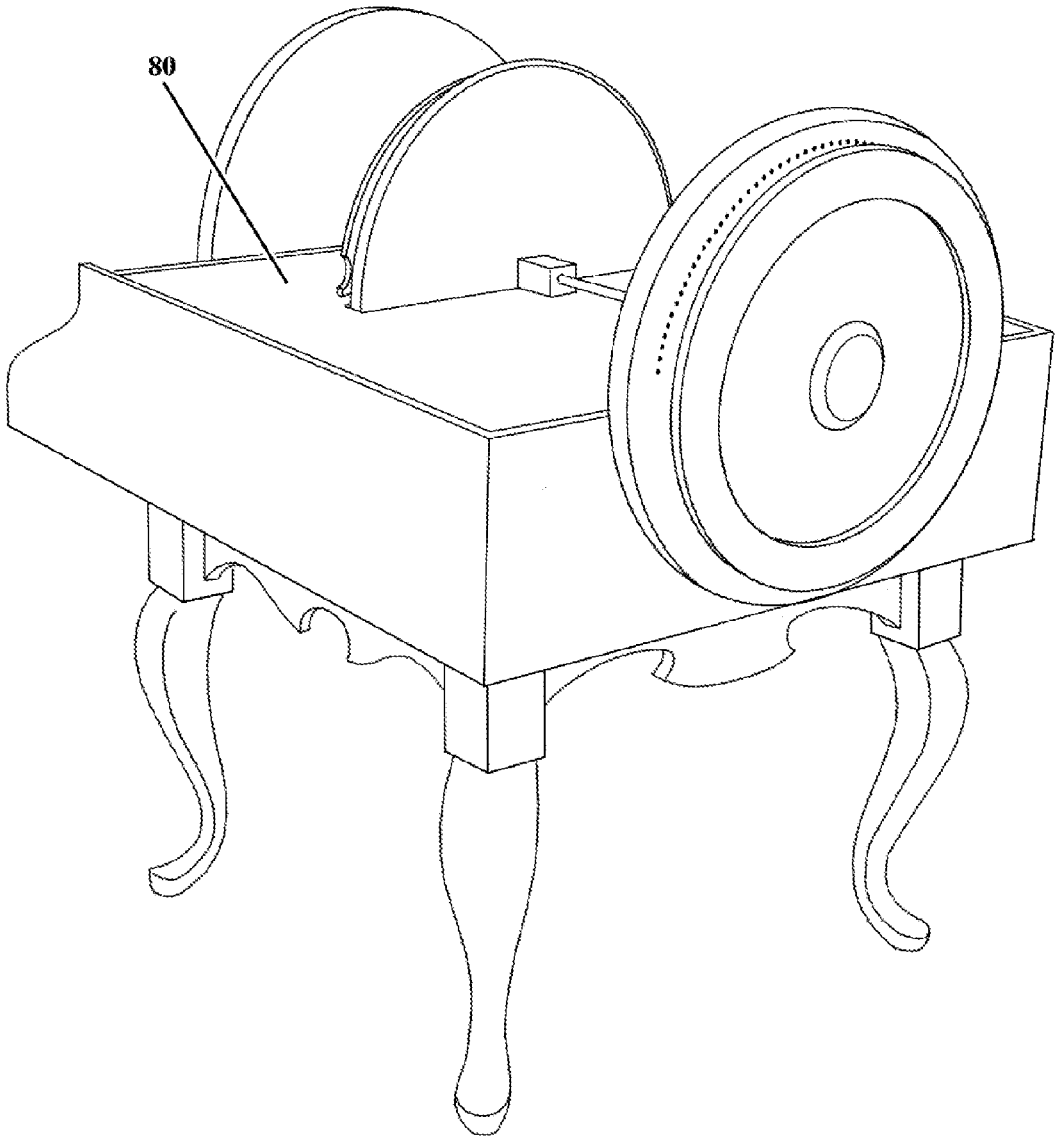
FIG. 8 shows a flat soundboard.

Soundboards 80 of various shapes may be employed. FIG. 8 shows an implementation where the soundboard 80 is a planar surface. Because of its resonance characteristics, the planar soundboard 80 may result in superior acoustic qualities in comparison to soundboards of other shapes.

Figure 9:
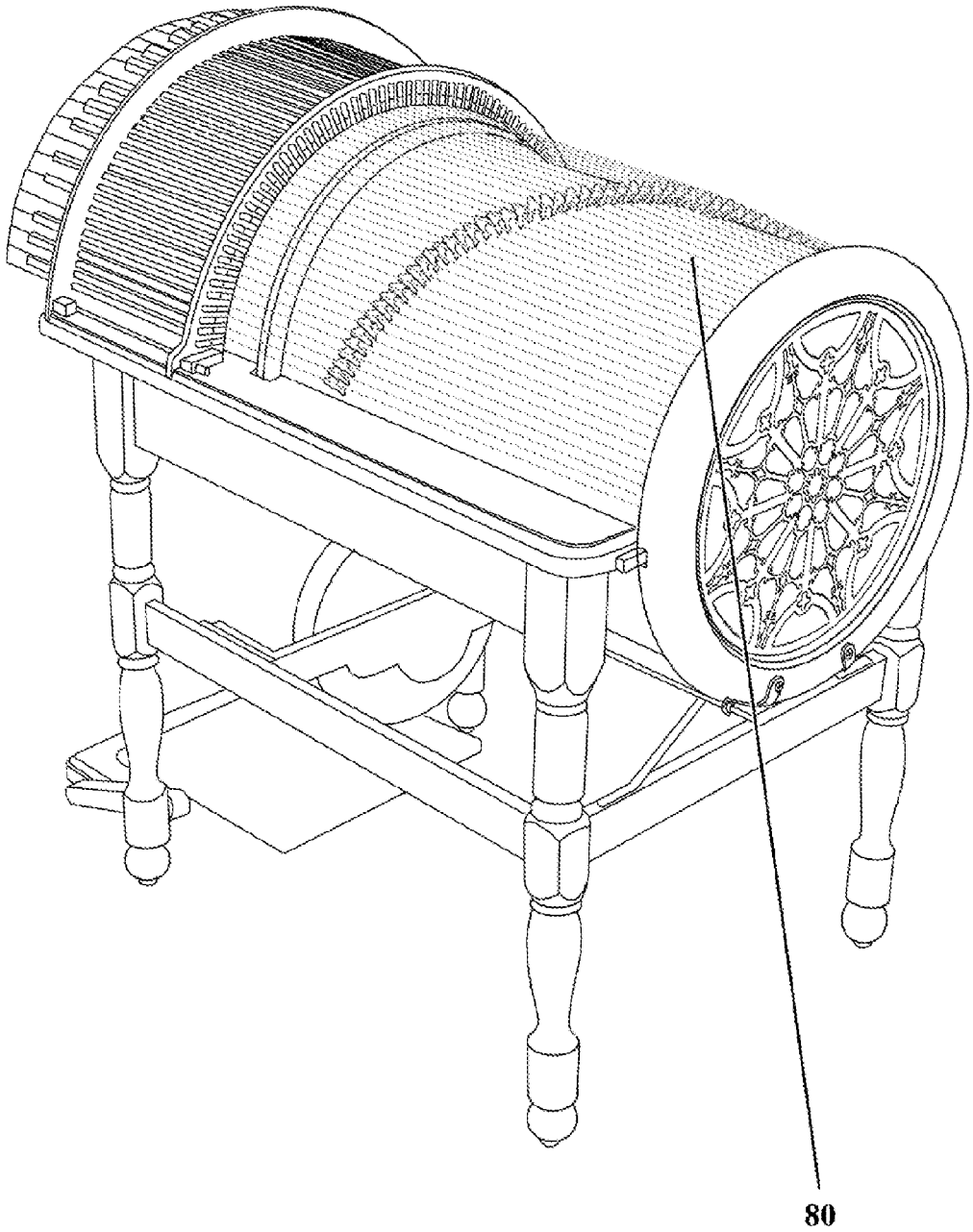
FIG. 9 shows a tubular soundboard.

FIG. 9 shows an implementation where the soundboard 80 is a cylindrical surface. A soundboard 80 of this shape may result in the instrument being more compact and may lend it a distinct appearance.

Figure 10:
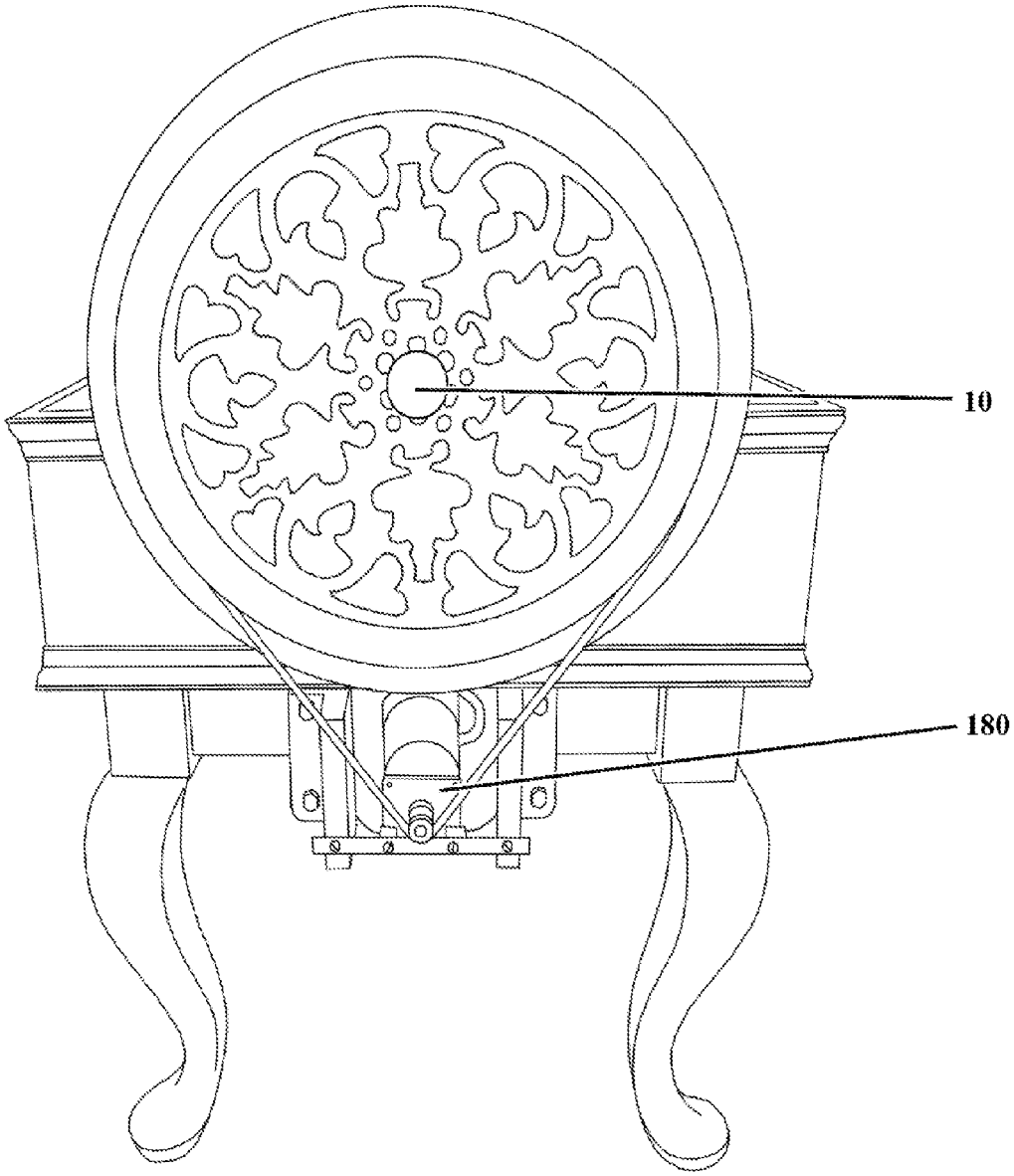
FIG. 10 shows a driving mechanism driven by a motor.
Figure 11:
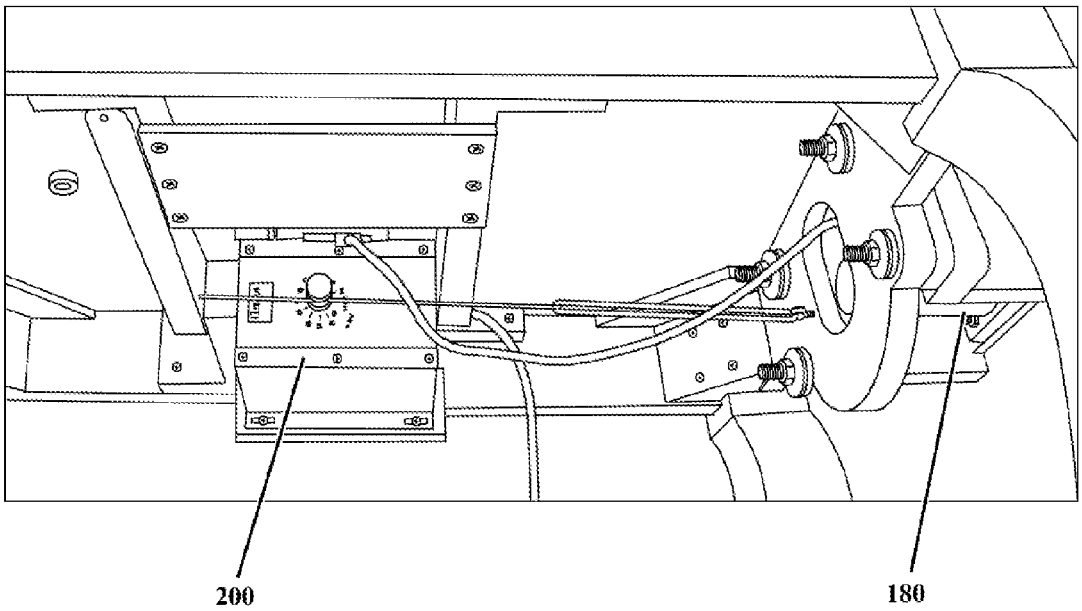
FIG. 11 shows a motor speed controller system.

The driving mechanism 10 can be motorized. FIG. 10 shows an implementation in which the driving mechanism 10 is turned by a motor 180, via a pulley system 190. FIG. 11 shows a motor speed controller unit 200 that allows the driving mechanism 10 to be rotated at various speeds, allowing the user to mechanically vary the volume of the instrument.

Figure 12:
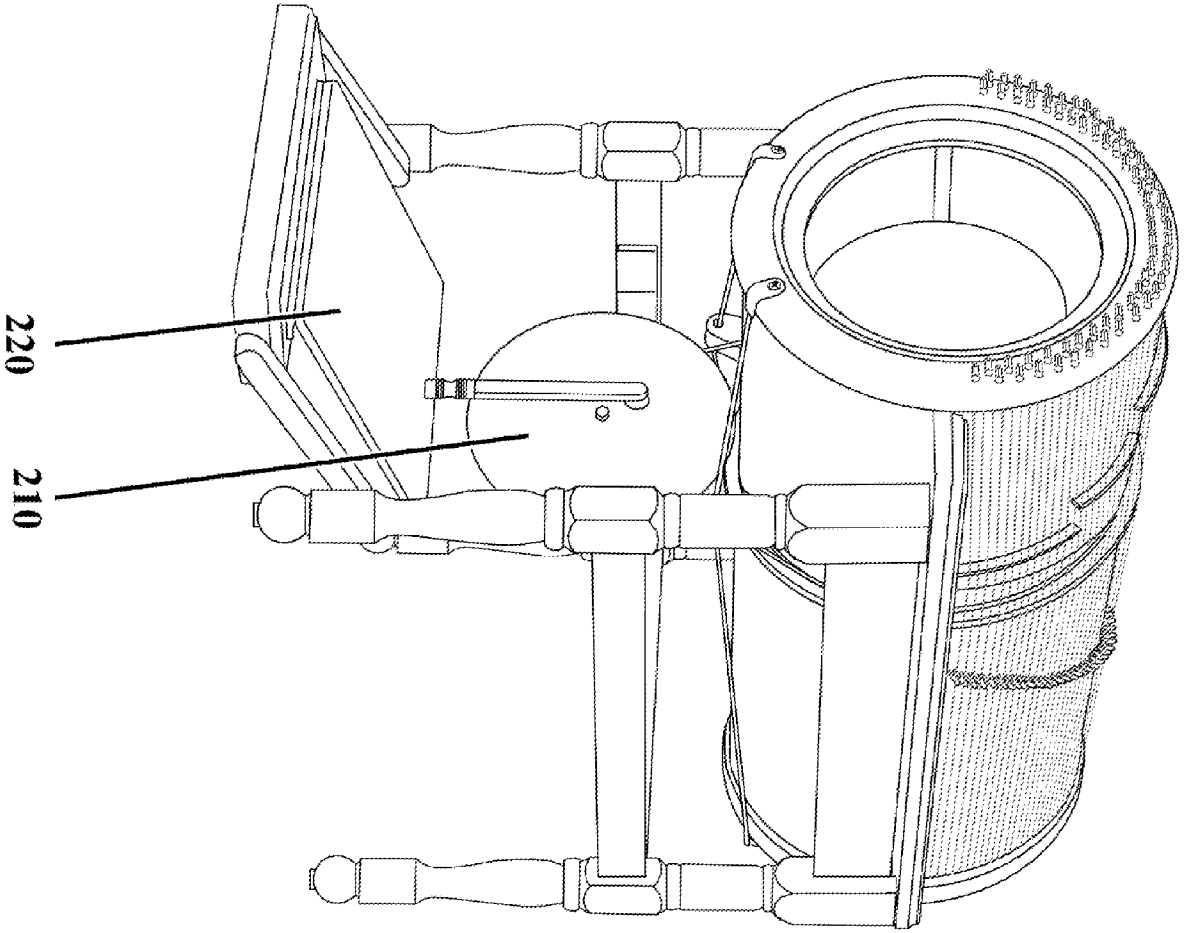
FIG. 12 shows a driving mechanism driven by a foot-powered treadle system.

The driving mechanism 10 can also be human-powered. FIG. 12 shows an implementation in which the driving mechanism 10 is turned by a treadle wheel 210, which is itself turned by a pedal 220 that is depressed by the user's foot.

Figure 13:
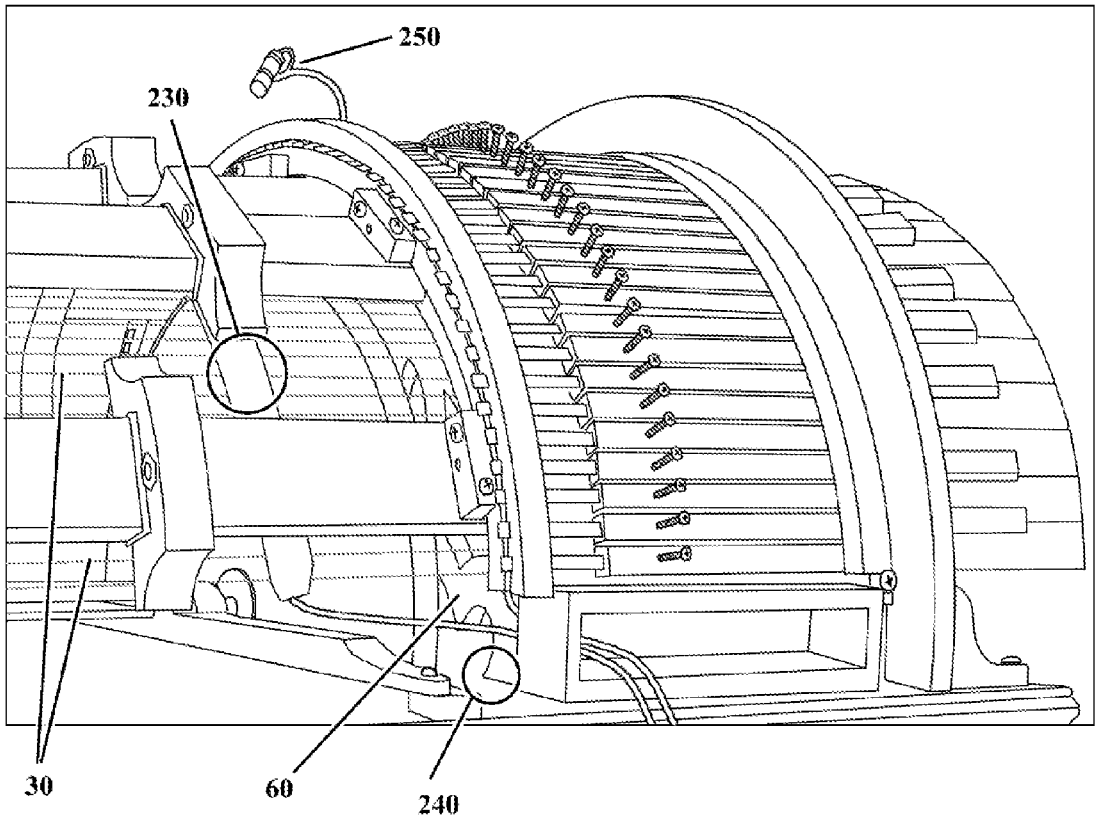
FIG. 13 shows three possible means of electronic transduction: electromagnetic pickup; piezoelectric transducer; and microphone.

Some implementations feature a means for converting string vibration to an electrical signal. For example, FIG. 13 illustrates three such means: an electromagnetic pickup 230 placed near a vibrating metal string 30 such that the changes in magnetic flux generate an electrical signal; a piezoelectric transducer 240, attached to the bridge 60, that converts the vibrations of the bridge 60 to an electrical signal; and a microphone 250 that converts changes in acoustic pressure into an electrical signal.

Figure 14:
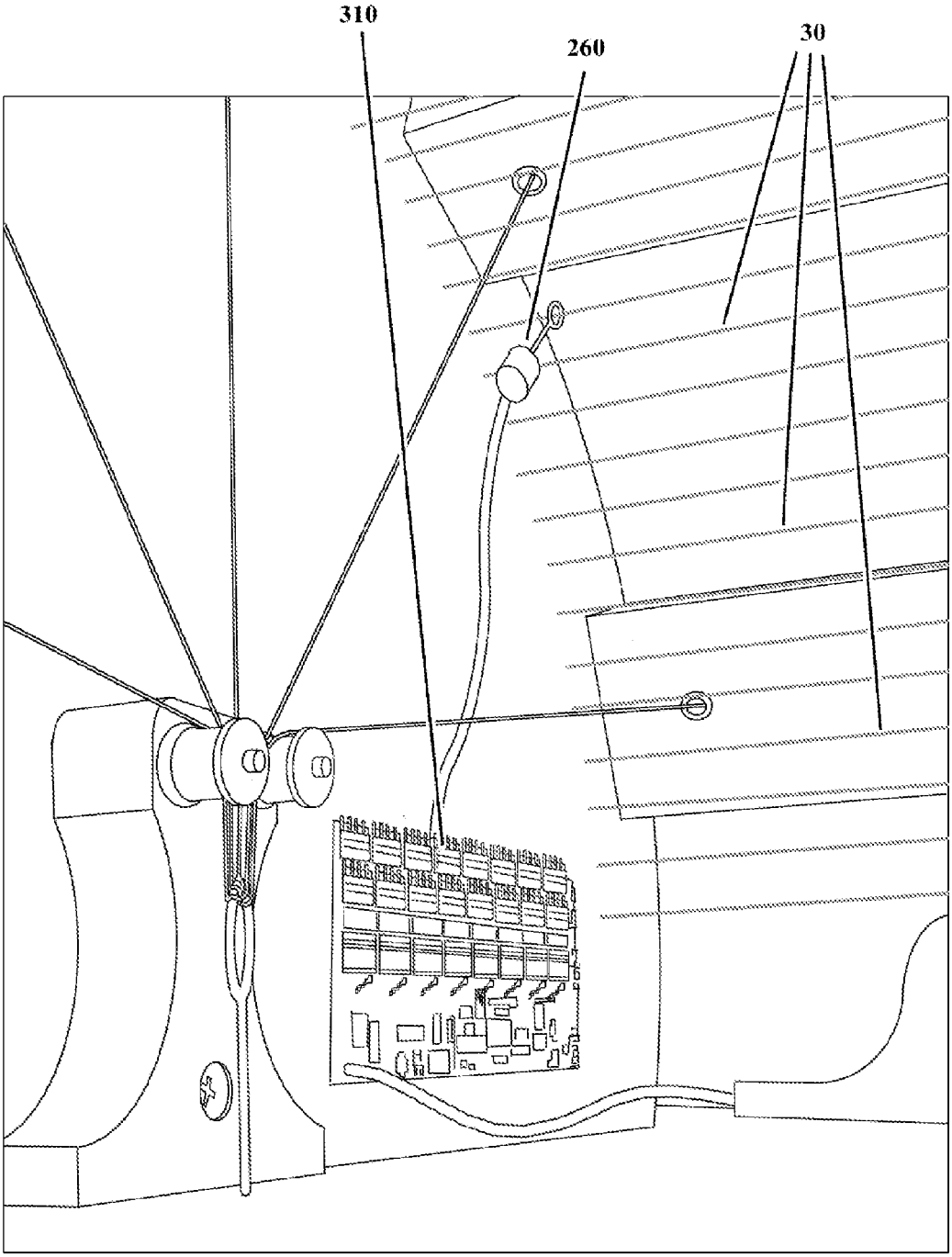
FIG. 14 shows solenoids used as string actuators and controlled via a MIDI system.

Actuators 100 may comprise a plurality of electromagnetic switches, such as solenoids or relays, that each bring a corresponding vibratable string 30 into contact with the movable member 20 when the switch is opened or closed via an electrical or magnetic signal. FIG. 14 illustrates one such example system, in which each vibratable string 30 corresponds to one solenoid 260. Electromagnetic switching systems allow operation without real-time human input. For example, the solenoids 260 in FIG. 14 could be controlled by electrical signals conforming to the Musical Instrument Digital Interface (MIDI) standard. These signals may be prerecorded, allowing the instrument to play notes without real-time human assistance, similar to a player piano. Circuit board 310 is a digital interface that allows MIDI signals to control actuators such as solenoids.

Some implementations employ one or more vibratable strings 30, known as "drone strings," that remain in contact with the movable member 20 even without actuation. As one example, referring to FIG. 6, drone strings 30 can be employed simply by sufficiently lowering the height of the vibratable string 30 relative to the movable member 20 (the "action").

Figure 15:
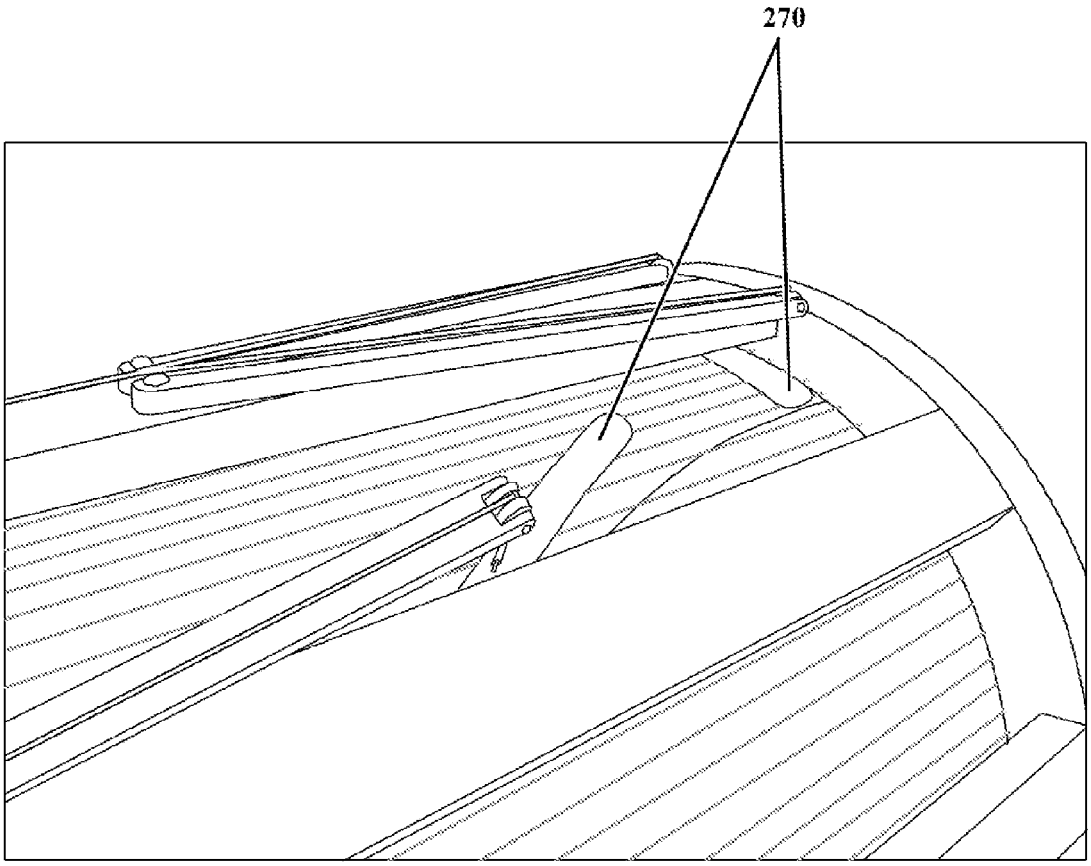
FIG. 15 shows a string dampening mechanism.

Some implementations feature a means for attenuating the amplitude of the vibrations of vibratable strings, for example, a string dampening mechanism that attenuates the amplitude of a vibrating string 30 to generate muffled or staccato tones. In FIG. 15, an example of such a means is shown: a dampening apparatus, such as an array of metal strips with foam damping pads 270 underneath, is raised and lowered onto vibratable strings 30 via a foot pedal 280 to engage and disengage the dampening effect.

Figure 16:
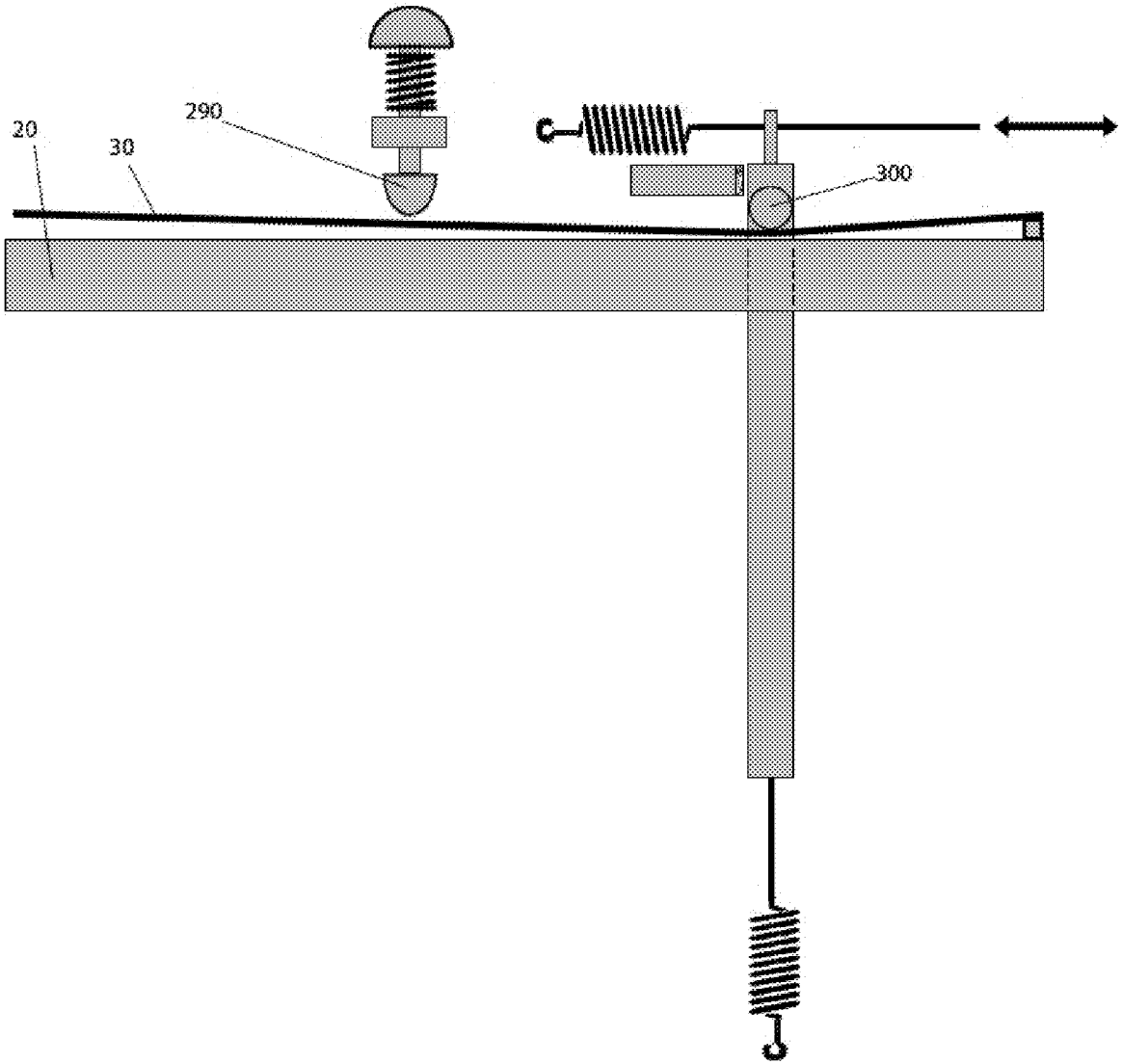
FIG. 16 shows a trill mechanism and a vibrato mechanism, respectively.

Some implementations feature a means for modulating the pitch or volume of a vibratable string while the string is vibrating, for example to simulate the finger-based volume and pitch adjustments possible with a violin. For example, the trill mechanism shown in FIG. 16 engages a spring-loaded artificial "finger" 290 to press one of strings 30 against movable member 20. (This mechanism may act in parallel with the cable linkage system described above, such that either the trill mechanism or a cable-linked actuator 100 may press one of vibratable strings 30 against movable member 20.) The trill mechanism may thus be used to create staccato or tremolo effects, where a note is repeatedly played and released in a rhythmic pattern. FIG. 16 also illustrates a vibrato mechanism that adjusts the tension of a vibratable string 30 to create small adjustments in the pitch of a played note. In the example shown, the mechanism consists of an artificial "finger" 300 placed in contact with one of vibratable strings 30 and moved along the length of the vibratable string 30 by means of a cable linkage system such as described above. Moving the finger as such changes the effective length of the vibratable string 30 and thus changes the pitch of the note played as the string vibrates.

What is claimed is:

1. A musical instrument comprising:

a soundboard;

a bridge in contact with the soundboard;

a plurality of more than thirteen vibratable strings in contact with the bridge;

a single substantially cylindrical movable member disposed adjacent to the plurality of vibratable strings;

a driving mechanism engaged with the movable member and configured to cause the movable member to move relative to the vibratable strings; and a plurality of actuators, each actuator corresponding to an associated vibratable string, wherein each actuator is configured to displace, when actuated, an associated vibratable string such that said string is caused to come into contact with the movable member at one or more points of contact, wherein displacement of said string corresponds to movement within a first plane that is orthogonal to a second plane, the second plane being tangential to the movable member at said point of contact.

2. The musical instrument of claim 1, wherein the soundboard comprises a substantially planar surface.

3. The musical instrument of claim 1, wherein the soundboard is non-tubular.

4. The musical instrument of claim 1, wherein the driving mechanism comprises a rotating shaft that causes the movable member to rotate about a center axis.

5. The musical instrument of claim 4, wherein the movable member comprises a radial axis that is collinear with the rotating shaft.

6. The musical instrument of claim 5, wherein the soundboard comprises a substantially planar surface.

7. The musical instrument of claim 5, wherein the soundboard is non-tubular.

8. The musical instrument of claim 1, further comprising a pivot post in contact with the bridge at a contact point, wherein vibration of a vibratable string causes the bridge to vibrate relative to said pivot post.

9. The musical instrument of claim 8, wherein the pivot post is configured to allow movement and permanent adjustment of the pivot post's position along the axis of the pivot post.

10. The musical instrument of claim 9, wherein the soundboard comprises a substantially planar surface.

11. The musical instrument of claim 9, wherein the soundboard is non-tubular.

12. The musical instrument of claim 1, wherein each actuator comprises an electrical switch.

13. The musical instrument of claim 12, wherein each actuator may be actuated via electrical signals conforming to the Musical Instrument Digital Interface standard.

14. The musical instrument of claim 9, wherein the contact point of the pivot post is substantially central relative to the bridge length.

15. The musical instrument of claim 14, wherein the bridge has two feet that contact the soundboard.

16. The musical instrument of claim 9, wherein the pivot post is threaded and a threaded insert allows both movement and fine permanent adjustment of the position of the pivot post.

17. The musical instrument of claim 14, wherein the pivot post is threaded and a threaded insert allows both movement and fine permanent adjustment of the position of the pivot post.

18. The musical instrument of claim 15, wherein the pivot post is threaded and a threaded insert allows both movement and fine permanent adjustment of the position of the pivot post.

19. A musical instrument comprising:

a soundboard;

a bridge in contact with the soundboard;

a plurality of more than thirteen vibratable strings in contact with the bridge;

a single moveable member disposed adjacent to the plurality of vibratable strings, wherein the moveable member comprises a substantially cylindrical shape;

a driving mechanism engaged with the moveable member and configured to cause the moveable member to move relative to the vibratable strings, wherein the driving mechanism comprises a rotating shaft configured to cause the moveable member to rotate about a center axis;

a pivot post in contact with the bridge at a contact point, wherein vibration of a vibratable string causes the bridge to vibrate relative to said pivot post, wherein the pivot post is configured to allow movement and fine permanent adjustment of the pivot post's position along an axis of the pivot post; and a plurality of actuators, each actuator corresponding to an associated vibratable string, wherein each actuator is configured to displace, when actuated, an associated vibratable string such that said string is caused to come into contact with the moveable member at one or more points of contact, wherein displacement of said string corresponds to movement within a first plane that is orthogonal to a second plane, the second plane being tangential to the moveable member at said point of contact.

20. The musical instrument of claim 19, wherein the soundboard comprises a substantially planar surface.

21. The musical instrument of claim 19, wherein the soundboard is non-tubular.

22. The musical instrument of claim 19, further comprising a means for generating an electrical signal from the vibrations of the vibratable strings.

23. The musical instrument of claim 19, further comprising a means for attenuating the amplitude of the vibrations of the vibratable strings.

24. The musical instrument of claim 19, further comprising a means for modulating the pitch or volume of a vibratable string while said vibratable string is vibrating.

25. The musical instrument of claim 19, wherein each actuator comprises an electrical switch.

26. The musical instrument of claim 25, wherein each actuator may be actuated via electrical signals conforming to the Musical Instrument Digital Interface standard.

27. The musical instrument of claim 19, wherein the contact point of the pivot post is substantially central relative to the bridge length.

28. The musical instrument of claim 27, wherein the bridge has two feet that contact the soundboard.

29. The musical instrument of claim 19, wherein the pivot post is threaded and a threaded insert allows both movement and fine permanent adjustment of the position of the pivot post.

30. The musical instrument of claim 27, wherein the pivot post is threaded and a threaded insert allows both movement and fine permanent adjustment of the position of the pivot post.

31. The musical instrument of claim 28, wherein the pivot post is threaded and a threaded insert allows both movement and fine permanent adjustment of the position of the pivot post.

32. A musical instrument comprising:

a soundboard comprising a substantially planar surface;

a bridge in contact with the soundboard;

a plurality of more than thirteen vibratable strings in contact with the bridge;

a single moveable member disposed adjacent to the plurality of vibratable strings, wherein the moveable member comprises a substantially cylindrical shape;

a driving mechanism engaged with the moveable member and configured to cause the moveable member to move relative to the vibratable strings, wherein the driving mechanism comprises a rotating shaft that causes the moveable member to rotate about a center axis;

a pivot post in contact with the bridge at a contact point, wherein vibration of a vibratable string causes the bridge to vibrate relative to said pivot post, wherein the pivot post is configured to allow movement and fine permanent adjustment of the pivot post's position along an axis of the pivot post;

a plurality of actuators, each actuator corresponding to an associated vibratable string, wherein each actuator is configured to displace, when actuated, an associated vibratable string such that said string is caused to come into contact with the movable member at one or more points of contact, wherein displacement of said string corresponds to movement within a first plane that is orthogonal to a second plane, the second plane being tangential to the movable member at said point of contact;

means for generating an electrical signal from the vibrations of the vibratable strings;

means for attenuating the amplitude of the vibrations of the vibratable strings; and means for modulating the pitch or volume of a vibratable string while said vibratable string is vibrating.

33. The musical instrument of claim 32, wherein each actuator comprises an electrical switch.

34. The musical instrument of claim 33, wherein each actuator may be actuated via electrical signals conforming to the Musical Instrument Digital Interface standard.

35. A musical instrument comprising:

a soundboard;

a substantially semicircular bridge in contact with the soundboard;

a plurality of vibratable strings in contact with the bridge;

a substantially cylindrical movable member, disposed adjacent to the plurality of vibratable strings;

a driving mechanism engaged with the movable member and configured to cause the movable member to move relative to the vibratable strings; and a plurality of actuators, each actuator corresponding to an associated vibratable string, wherein each actuator is configured to displace, when actuated, an associated vibratable string such that said string is caused to come into contact with the movable member at one or more points of contact, wherein displacement of said string corresponds to movement within a first plane that is orthogonal to a second plane, the second plane being tangential to the movable member at said point of contact.

36. The musical instrument of claim 35, wherein the soundboard comprises a substantially planar surface.

37. The musical instrument of claim 35, wherein the soundboard is non-tubular.

38. The musical instrument of claim 35, further comprising a pivot post in contact with the bridge at a contact point, wherein vibration of a vibratable string causes the bridge to vibrate relative to said pivot post, and wherein the pivot post is configured to allow movement and fine permanent adjustment of the pivot post's position along the axis of the pivot post.

39. The musical instrument of claim 38, wherein the contact point of the pivot post is substantially central relative to the bridge length.

40. The musical instrument of claim 39, wherein the bridge has two feet that contact the soundboard.

41. The musical instrument of claim 38, wherein the pivot post is threaded and a threaded insert allows both movement and fine permanent adjustment of the position of the pivot post.

42. The musical instrument of claim 39, wherein the pivot post is threaded and a threaded insert allows both movement and fine permanent adjustment of the position of the pivot post.

43. The musical instrument of claim 40, wherein the pivot post is threaded and a threaded insert allows both movement and fine permanent adjustment of the position of the pivot post.

44. The musical instrument of claim 35, wherein each actuator comprises an electrical switch.

45. The musical instrument of claim 35, further comprising a means for generating an electrical signal from the vibrations of the vibratable strings.

46. The musical instrument of claim 35, further comprising a means for attenuating the amplitude of the vibrations of the vibratable strings.

47. The musical instrument of claim 35, further comprising a means for modulating the pitch or volume of a vibratable string while said vibratable string is vibrating.

* * * * *